US007364517B1

(12) United States Patent
Johnsen

(10) Patent No.: US 7,364,517 B1
(45) Date of Patent: Apr. 29, 2008

(54) SOCCER PRACTICE APPARATUS

(76) Inventor: Brian Peter Johnsen, 5308 Trace Ridge Cir., Hoover, AL (US) 35244

( * ) Notice: Subject to any disclaimer, the term of this patent is extended or adjusted under 35 U.S.C. 154(b) by 0 days.

(21) Appl. No.: 11/245,705

(22) Filed: Oct. 7, 2005

(51) Int. Cl.
*A63B 69/00* (2006.01)

(52) U.S. Cl. ..... 473/446; 473/422

(58) Field of Classification Search ..... 473/422–430, 473/446, 471
See application file for complete search history.

(56) References Cited

U.S. PATENT DOCUMENTS

| | | | | |
|---|---|---|---|---|
| 1,345,789 | A | 7/1920 | Linley | |
| 2,976,040 | A * | 3/1961 | Bales | 473/429 |
| 3,166,317 | A | 1/1965 | Tumelson | |
| 3,588,104 | A * | 6/1971 | Griffin | 473/424 |
| D246,130 | S | 10/1977 | Koblick | |
| 4,191,372 | A | 3/1980 | Keller | |
| 4,278,257 | A | 7/1981 | Garcia et al. | |
| 4,462,599 | A * | 7/1984 | Brown | 473/430 |
| 4,576,379 | A * | 3/1986 | Juhasz | 473/430 |
| 4,706,964 | A * | 11/1987 | Genovese | 473/575 |
| 5,083,797 | A * | 1/1992 | Vartija et al. | 473/424 |
| 5,094,462 | A | 3/1992 | Boyle et al. | |
| 5,398,940 | A * | 3/1995 | Derst, III | 473/430 |
| 5,553,848 | A * | 9/1996 | Amron | 473/416 |
| 5,611,539 | A * | 3/1997 | Watterson et al. | 473/197 |
| 5,669,837 | A | 9/1997 | Hauter | |
| 5,957,789 | A * | 9/1999 | Ainscough et al. | 473/423 |
| 6,099,419 | A * | 8/2000 | Incaudo et al. | 473/429 |
| D431,061 | S * | 9/2000 | Solis | D21/719 |
| 7,115,051 | B2 * | 10/2006 | Hansberry | 473/423 |

FOREIGN PATENT DOCUMENTS

| | | | |
|---|---|---|---|
| GB | 2302032 | A * | 1/1997 |

* cited by examiner

*Primary Examiner*—Mitra Aryanpour
(74) *Attorney, Agent, or Firm*—Needle & Rosenberg, PC

(57) ABSTRACT

A soccer practice apparatus to assist a user in practicing the ability to power kick, ball control, mid-volley and/or head a soccer ball. The apparatus can be formed from an arm assembly comprised of a primary arm member angled with a smooth bend to a substantially vertical portion at the end. The arm assembly is connected to a substantially vertical support member. A tether cord extends through and along a length of the primary arm member and is attached to a soccer ball. The tether cord is adjustable and permits the height of the ball to be adjusted for ground ball positions, mid volleys, and heading. The apparatus further permits a ball to be hit in any direction from any adjusted position above ground without creating ball contact with the upright support member.

18 Claims, 5 Drawing Sheets

SOCCER PRACTICE APPARATUS

FIELD OF THE INVENTION

The present invention relates generally to the field of sporting goods and, more specifically, to a practice apparatus by which users of all ages can, among other activities, develop and improve their ability to power kick, ball control, mid-volley, or head a soccer ball.

BACKGROUND OF THE INVENTION

Soccer is a game played on a field between two teams of eleven players each, with the object being to propel a round ball into the opponent's goal by kicking or by hitting it with any part of the body except the hands and arms. Soccer practice typically consists of a coach and teammates engaging in warm-ups, skill drills, speed-endurance drills, game situations and repetitive drills with each other. Players can benefit from repeated ball contacts where eye-ball-body coordination in a limited space and time result in improved play. To this end, the number of continuous repetitions with a ball usually depends on the skill of the other players or coach, whereby the better players typically get much more ball contact than less skilled players. Of course, in many situations a team coach and other teammates are not always available for practice situations and, as such, there is a need for a soccer practice apparatus that can enable one to practice the game by oneself, whereby the player can repetitively practice kicking the ball or otherwise causing the ball to move, such as hitting it with his head or other body parts.

Several previous attempts have been made to provide a soccer practice apparatus that can assist a player in training for the game of soccer. However, none of these conventional apparatus have been effective in providing a single apparatus that can enable one or more users to repetitively practice virtually any desired ball striking position, including full power ground kicks, mid-volleys, and headers, while minimizing elapsed time between repetitions by, for example, removing the potential for the ball to travel great distances requiring laborious and time consuming retrieval efforts and/or by removing the potential for the ball to become tangled or otherwise obstructed by other users and/or the apparatus itself. Accordingly, the present invention is designed, in part, to meet the above described needs and to overcome additional drawbacks of conventional soccer training apparatuses.

SUMMARY OF THE INVENTION

Among other aspects that will be described below, the present invention provides a soccer practice apparatus by which users of all ages can, among other activities, develop and improve their ability to power kick, ball control, mid-volley, or head a soccer ball.

Accordingly, in a first aspect, the present invention provides a soccer practice apparatus comprised of an arm member connected to and extending outwardly from a substantially upright support member supportable at ground level. A tether cord extends from a tip portion of the arm member and is connected to a ball, such as a soccer ball, by a ball attachment assembly. The length of tether cord extending from the tip portion of the arm member can be increased or decreased to vary the position of the ball relative to the ground to thereby bring it into position to be either kicked with the foot or struck by another part of the body, such as the leg, the chest or the head. The tip portion of the arm member is sufficiently spaced apart from the upright support member to assure that the upright support member is well away from the ball, thereby removing the possibility of the ball accidentally hitting or otherwise becoming obstructed by the upright support member when a user is kicking or striking the ball.

In a second aspect, the present invention provides a soccer practice apparatus kit, comprising an arm assembly which can be connected to an upright support member supportable at ground. The arm assembly comprises a primary arm member connected to a mount subassembly and extends outwardly from the mount subassembly at an angle that is less than or equal to 90° relative to the longitudinal axis of the mount subassembly.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

The accompanying drawings, which are incorporated in and constitute a part of this specification, illustrate certain aspects of the instant invention and together with the description, serve to explain, without limitation, basic principles of the invention.

DETAILED DESCRIPTION OF THE INVENTION

Figure 1:
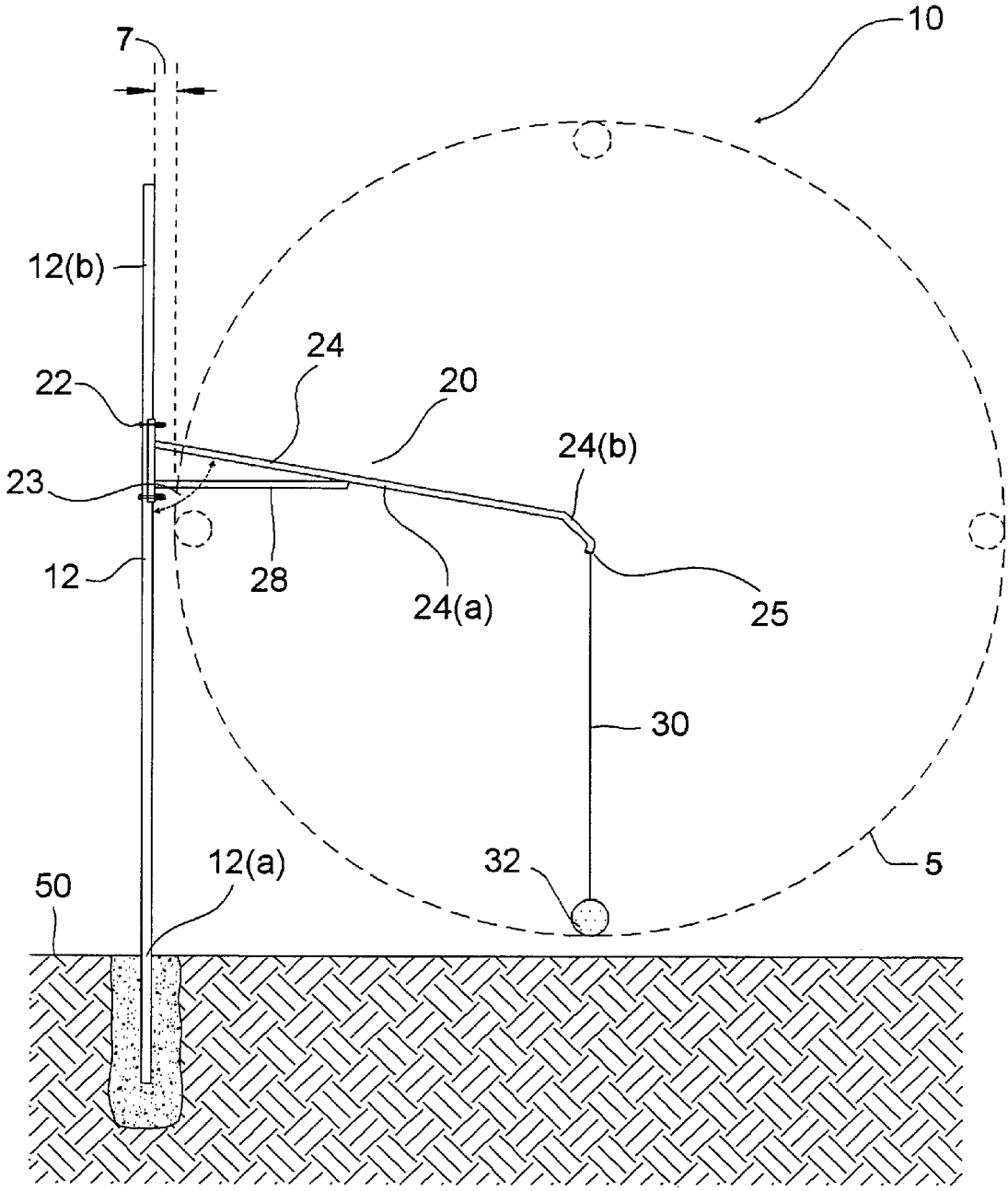
FIG. 1 is a side view of an exemplary soccer practice apparatus according to one aspect of the present invention.

The present invention can be understood more readily by reference to the following detailed description, drawings, and claims, and their previous and following description. However, before the present devices and/or methods are disclosed and described, it is to be understood that this invention is not limited to the specific articles, devices, and/or methods disclosed unless otherwise specified, as such can, of course, vary. It is also to be understood that the terminology used herein is for the purpose of describing particular aspects only and is not intended to be limiting of the invention as claimed.

To that end, the following detailed description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and therefore are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to an "arm assembly" includes aspects having two or more such arm assemblies unless the context clearly indicates otherwise.

Ranges can and may be expressed herein as from "about" one particular value, and/or to "about" another particular value. When such a range is expressed, another aspect includes from the one particular value and/or to the other particular value. Similarly, when values are expressed as approximations, by use of the antecedent "about," it should also be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As briefly stated above, the present invention relates generally to the field of sporting goods and, more specifically to a soccer practice apparatus that can enable athletes of all ages to, among other activities, practice, develop, and/or improve their ability to power kick, ball control, mid-volley, or head a soccer ball. In general concept, the present invention provides an arm member connected to and extending outwardly from a substantially upright support member supportable at ground level. A distal end of a tether cord extends from a tip portion of the arm member and is connected to a ball such as a soccer ball. The length of tether cord extending from the tip portion of the arm member can be increased or decreased to vary the position of the ball relative to the ground to thereby bring it into position to be either kicked with the foot or hit by another part of the body, such as the leg, the chest or the head. The tip portion of the arm member is sufficiently spaced apart from the upright support member to assure that the upright support member is well away from the ball, thereby removing the possibility of the user accidentally kicking or hitting the upright support member while kicking or hitting the ball.

With specific reference to the appended figures, several aspects of the present invention are illustrated. FIG. 1 shows an exemplary soccer practice apparatus 10. The soccer practice apparatus 10 comprises an upright member 12 having a longitudinal axis and a lower portion 12(*a*) supportable at ground level 50 and a top portion 12(*b*) extending substantially vertically and upwardly from the base portion. An arm assembly 20, comprising a mount subassembly 22, is connected to the upright member at a predetermined position above the lower portion of the upright support member. The arm assembly 20 further comprises a primary arm member 24 connected to the mount subassembly 22 and comprising a base portion 24(*a*) extending outwardly from the mount subassembly at an angle 23 that is less than or equal to 90° relative to the longitudinal axis of the upright support member 12. To that end, in those aspects where the angle 23 is less than 90°, the base portion 24(*a*) will extend outwardly and downwardly away from the upright support member 12. A tip portion 24(*b*) extends outwardly and downwardly from the distal end of the base portion such that an open tip end 25 extends toward ground level 50. A tether cord 30 having a distal end connected to a soccer ball extends from the open tip end 25 of the primary arm member. The distance between the open tip end 25 and the upright member 12 is greater than the distance between the open tip end and the ground level, thus eliminating the possibility of the user accidentally kicking or hitting the upright support member while kicking or hitting a suspended ball.

As further illustrated in FIG. 1, the upright support member 12 can in one aspect be a fixed support pole supportable at ground level by any conventional means for supporting a support pole or similar structure at ground level. For example, in one aspect, the support pole can be a galvanized tubular steel pole. An exemplary pole can have a 2.25 inch diameter and can be inserted into an approximately 40 inch deep by approximately 10 to 14 inch diameter hole, depending on soil conditions, (using a post hole digger or similar device) in the ground using concrete to fill the hole evenly on the bottom and sides to just below grass or surrounding ground height. The support pole can further be threaded on one or both ends so that a galvanized threaded top cap can be applied to the top of the support pole to prevent rain water from entering and promoting rust from forming on the pole from the inside.

In another aspect, the upright support member 12 can be portable and/or removably fixed at ground level, thus having a movable lower portion or base portion 12(*a*) comprised of a sufficiently heavy material, such as iron or a pinned steel tube, in order to give it sufficient strength to remain level when forces are indirectly imparted upon it during normal usage of the soccer practice apparatus. For example, in one aspect, an upright support member may be a steel tube sized and shaped to be inserted into another steel tube embedded in concrete. According to this aspect, when the apparatus is not in use, the upright support member can be removed from the steel tube embedded in concrete. Alternatively, the movable base portion can be hollow and filled with a filler material, such as sand or water, in order to give it sufficient weight. In still another aspect, a movable base portion can comprise one or more openings which extend substantially vertically through the base portion and through which dowels or pegs can be inserted that can be extended into the ground in order to temporarily retain the base at a desired fixed location. An exemplary and non limiting portable base portion suitable for use in connection with the present invention is disclosed and described in U.S. Pat. No. 4,576,379, the entire disclosure of which is incorporated herein by reference.

In addition to the exemplified vertical support members described above, it should be understood that the support member 12 can be any substantially vertical support means capable of supporting an arm assembly of the present invention. For example, a suitable vertical support can also include, without limitation, a steel pole, concrete pole, telephone pole, concrete wall, brick wall, or even a corner of an existing structure or building.

Figure 2:
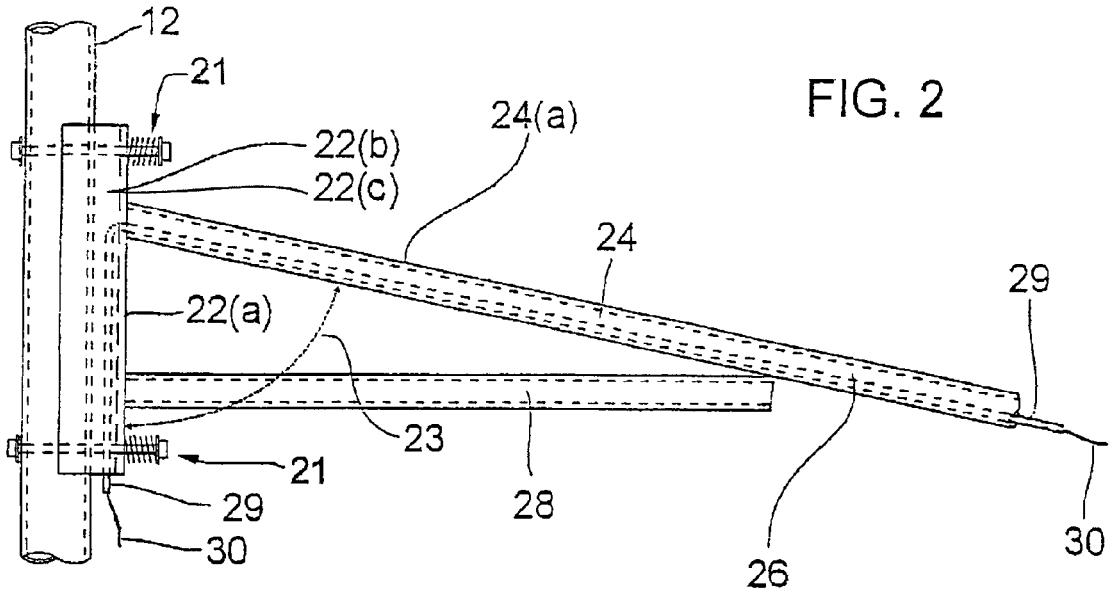
FIG. 2 is a side view of an exemplary portion of an arm assembly according to one aspect of the present invention.
Figure 3:
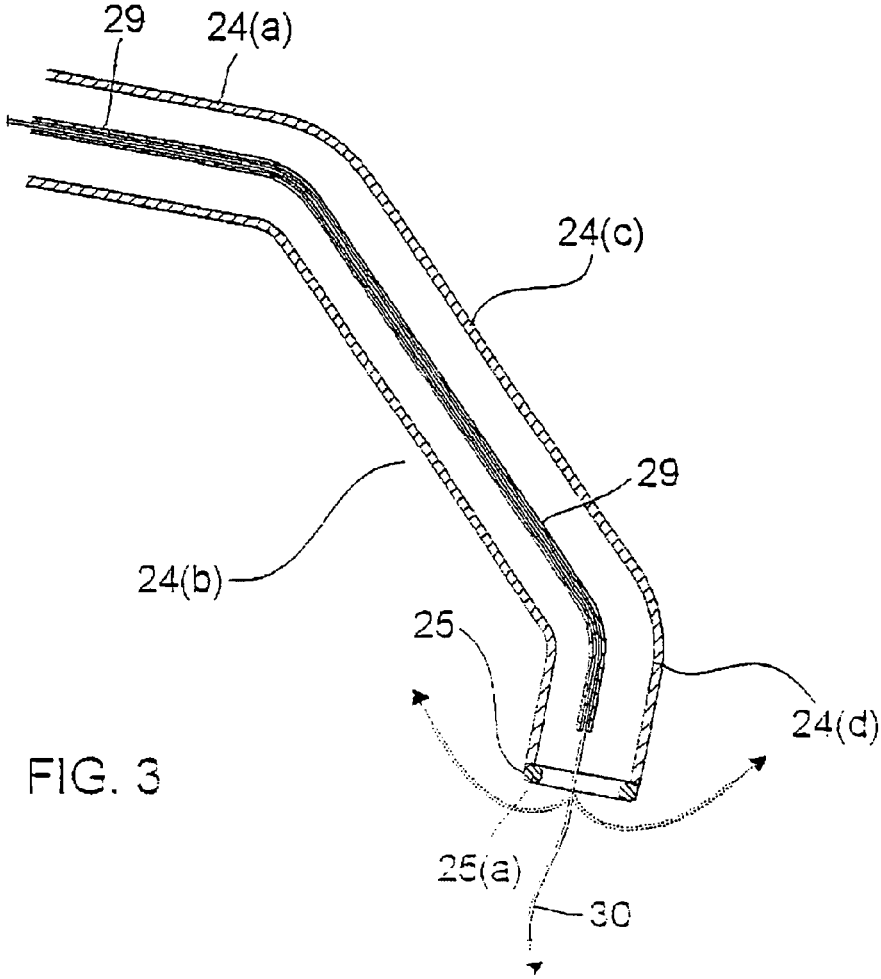
FIG. 3 is a side view of an exemplary tip portion of an arm assembly according to one aspect of the present invention.

FIGS. 2 and 3 illustrate an exemplary arm assembly 20 according to one aspect of the present invention. As shown, the arm assembly 20 can comprise a primary arm member 24 having a base portion 24(*a*) and a tip portion 24(*b*). The primary arm member can be hollow such that it defines a primary arm member conduit 26 suitable for the passage of at least a portion of a tether cord 30. The base portion 24(*a*) can be connected to a mount subassembly 22, comprised of an elongated mount subassembly base member 22(*a*) and having a mount subassembly longitudinal axis. The base portion 24(*a*) extends outwardly from the mount subassembly 22 at an angle 23 that is less than or equal to 90° relative to the longitudinal axis of the mount subassembly base member. In those aspects where the angle 23 is less than 90° the base portion 24(*a*) will extend outwardly and downwardly away from the mount subassembly 22. In one aspect, the base portion 24(*a*) can extend outwardly and downwardly from the mount subassembly 22 at an angle 23 in the range of from approximately 45° to approximately 90°, including additional angles of 50°, 55°, 60°, 65°, 70°, 75°, 80°, and 85°.

The tip portion 24(*b*) can further extend outwardly and downwardly from the base portion 24(*a*) such that an open tip end 25 extends toward the ground level 50. In one aspect, the open tip end 25 can extend toward the ground level in a plane that is at least substantially parallel to the longitudinal axis of the mount subassembly. In another aspect, the open tip end 25 can extend toward ground level such that the area defined by the open tip end 25 is in a plane that is at least substantially parallel to the ground level. Alternatively, in still another aspect, the open tip end 25 can extend toward ground level such that the area defined by the open tip end 25 is in a plane that is at least substantially parallel to the base portion 24(*a*) of the primary arm member. In still another aspect, the open tip end 25 can extend such that the area defined by the open tip end 25 is itself in a plane that intersects the plane containing the longitudinal axis of the mount subassembly.

In one aspect, the tip portion 24(*b*) of the primary arm member is comprised of a single portion which can extend arcuately outwardly and downwardly from the distal end of the base portion 24(*a*). Alternatively, in another aspect, the tip portion 24(*b*) can further comprises a plurality of sub tip portions wherein each sub tip portion extends downwardly away from the previous sub portion. For example, in one aspect and as shown in FIG. 3, a primary arm member tip portion 24(*b*) can comprise a first tip portion 24(*c*) and second tip portion 24(*d*), wherein the first tip portion extends outwardly and downwardly from the distal end of the base portion 24(*a*) and wherein the second tip portion extends downwardly from the distal end of the first tip portion 24(*c*).

In still another aspect, it should be understood and appreciated that the primary arm member 24, including both the base and tip portions, can extend arcuately outwardly and downwardly from the mount subassembly 22. According to this aspect, the open tip end 25 can extend toward the ground level in a plane that is at least substantially parallel to the longitudinal axis of the mount subassembly or, alternatively, can extend such that the area defined by the open tip end 25 is itself in a plane that intersects the plane containing the longitudinal axis of the mount subassembly.

The primary arm member 24 is connected to the mount subassembly elongated base member 22(*a*) by any conventional means for forming a sufficiently strong connection to withstand the forces of stress exerted upon the apparatus during normal usage. For example, in one aspect, the primary arm member 24 can be welded to the mount subassembly elongated base member 22(*a*). To this end, in one aspect, the mount subassembly base member 22(*a*) can be comprised of an elongated galvanized steel base member. Further, the elongated base member can be in the form of a conventional C-channel or U-channel, sized and shaped to form a compatible connection with the exterior dimension of the upright member 12. For example, when configured for use with the exemplary galvanized steel support pole described above, the subassembly base member can be galvanized steel C-channel or U-channel approximately 12 inches in length, approximately 2.25 inches wide and forming a trough approximately 1.75 inches deep.

In still another aspect, it will be appreciated that the use of an appropriately sized and shaped C-channel or U-channel as the sub assembly mount base member can also provide a trough 22(*b*) that is adapted for passage of at least a portion of the tether cord 30. Accordingly, in one aspect, and as will be discussed in more detail below, the elongated mount subassembly base member can define a bore in communication with a proximal end of a hollow primary member 24 connected thereto. Whereby, when the elongated mount subassembly base member is connected to the upright member, a mount subassembly conduit 22(*c*) for the passage of the tether cord 30 is defined that is in communication with the primary arm member conduit 26.

If desired, the arm assembly 20 can further comprise a secondary arm member 28 having a first end connected to the elongated mount subassembly base member 22(*a*) and a second end connected to the base portion 24(*a*) of the primary arm member. To that end, it will be appreciated that the optional secondary arm member 28 can help to distribute the bending stresses that may be exerted upon the arm assembly during normal usage. Furthermore, depending upon the particular configuration, it should also be understood that specific location of the connection between the secondary arm member and the mount subassembly and/or the base portion 24(*a*) can vary.

The mount subassembly 22 can connected to the upright support member at a predetermined position such that the open tip end 25 of the primary arm member is above ground level. To that end, the open tip end can be any desired height above ground level, such as, for example, a height in the range of from 5 to 12 feet above ground level, including exemplary heights of 6, 7, 8, 9, 10, and 11 feet.

Further, the mount subassembly 22 can be connected to the upright support member by any conventional means capable of withstanding the stress and forces that may be exerted during normal usage of the soccer practice apparatus. In one aspect, the mount subassembly can be connected to the upright support member by any conventional means for forming a substantially rigid connection. For example, in one aspect, the mount subassembly can be bolted to the upright support member using conventional U-bolts. Alternatively, the mount subassembly can be bolted to the substantially upright support through bolt holes defined by and passing through the upright support member itself. In another aspect, the mount subassembly can be connected to the upright support member by one or more conventional metal band clamps. In still another aspect, the mount subassembly can be resiliently connected to the upright member by any conventional means for forming a resilient connection. For example, in one aspect, a means for forming a resilient connection can comprise one or more galvanized or stainless steel compression springs 21. The formation of a resilient connection, such as by the use of one or more compression springs, can give added compliance to the arm assembly in order to compensate for excess stresses and forces that may be placed upon the apparatus during inappropriate usage in order to help prevent against failure. The compression springs can be used in connection with a conventional bolt and nut to provide the resilient connection. If further desired, the nut can be equipped with a nylon lock insert, which, as one of skill in the art will appreciate, can also prevent the nut from vibrating loose during use.

As briefly mentioned above, the soccer practice apparatus of the present invention further comprises a tether cord 30 extending from the open tip end 25 of the primary arm member 24 and has a distal end connected to a soccer ball attachment assembly 40. The tether cord 30 can be constructed of any conventional tether cord materials such as, for example, a nylon cord.

In one aspect, the soccer practice apparatus can further comprise any conventional means for attaching and/or guiding the tether cord from the tether cord attachment assembly to the open tip end 25. Thus, in one aspect, a means for guiding the tether cord can be a guide system comprising one or more components which can reduce the coefficient of friction at a point of contact between the tether cord and the apparatus. For example, a tether cord guide system can comprise a system of one or more pulleys, one or more eyelets sized and shaped for the passage of the tether cord there through, or a combination thereof.

Furthermore, in another aspect, and as depicted in FIGS. 2 and 3, the primary arm member 24 can be hollow thereby defining a primary arm member conduit 26 adapted for the passage of at least a portion of the tether cord 30. Accordingly, at least a portion of the tether cord 30 can be threaded through the open tip end 25 of the primary arm member, through at least a portion of the primary arm member, and through at least a portion of the mount subassembly conduit 22(*c*). The proximal end of the tether cord 30 is threaded through the open tip end of the primary arm member and through at least a portion of the primary arm member conduit and mount subassembly base member conduit is connected to a tether cord attachment assembly 60, such as that shown in FIG. 4 and further discussed below.

If desired, one or more nylon inserts and/or a flexible hollow plastic tubing 29, such as polypropylene tubing, can also be provided as sheathing for at least a portion of the tether cord 30. The plastic tubing can act as a non-abrasive protection for the tether cord. In one aspect, the use of the flexible plastic tubing as a sheathing can help to prevent chaffing of the tether cord 30 during use and height adjustment. In a further aspect, the end of the flexible poly tube sheathing can be recessed in from the open tip end of the primary arm member, as illustrated in FIG. 3. This recess can allow the ball 32 to be pulled to a highest level without features of the soccer ball attachment assembly, such as a ball bearing swivel, getting caught or bound to the tip portion of the primary arm member or the flexible plastic sheathing. In one aspect, and depending on the dimensions of the particular soccer ball attachment assembly the distal end of the hollow plastic tube sheathing is recessed from the open tip end 25 a distance in the range of from approximately 10 to 20 inches, including distance of 12, 14, 16, and 18 inches. For example, the recess distance can, in one aspect, depend on the distance between a ball 32 and a swivel 42 as illustrated in FIG. 5.

In order to further prevent chafing and possible failure of a tether cord 30 that has been threaded through the open tip end 25 of the primary arm member, the open tip end 25 can also be sized and shaped such that it has a substantially smooth radiused circumferential edge. In one aspect, the hollow tip portion of the primary arm member can be flared or rounded at the open tip end. Alternatively, and as shown in FIG. 3, a galvanized or stainless steel toroid ring 25(*a*) can be welded to the open tip end of the primary arm member. To that end, the toroid ring 25(*a*) can, for example, be welded using a plurality of spot welds. Alternatively, a nylon rocket nozzle insert could be used to provide an open tip end 25 having a substantially smooth radiused circumferential edge.

Figure 4:
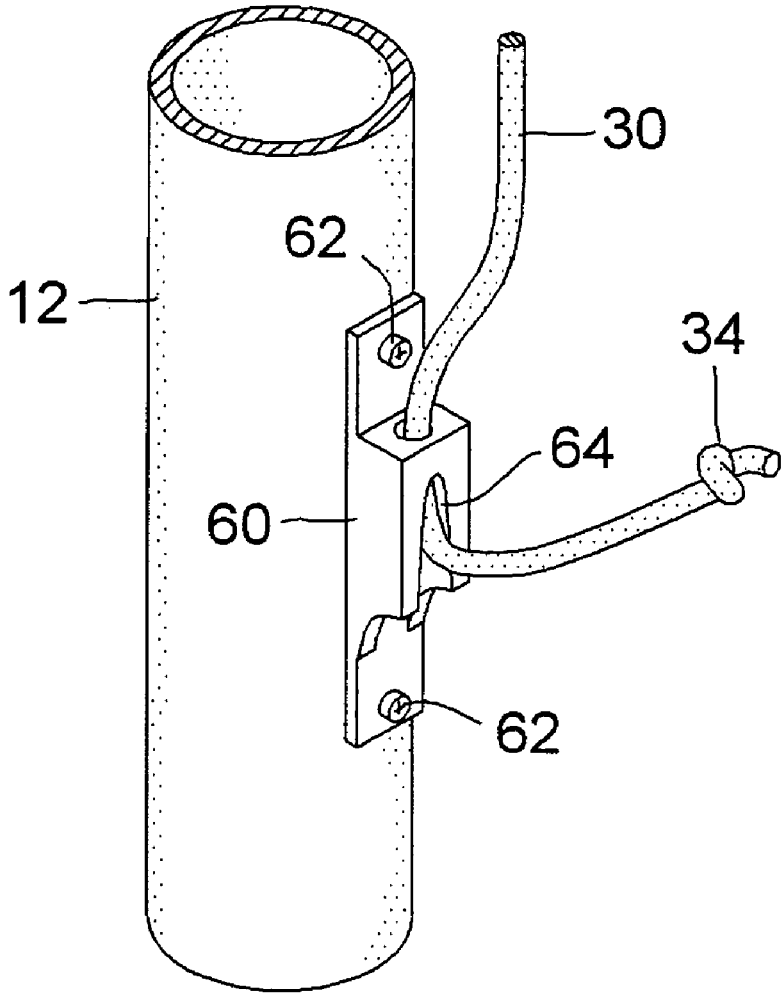
FIG. 4 is a perspective view of an exemplary tether cord attachment assembly according to one aspect of the present invention.

FIG. 4 shows an exemplary tether cord attachment assembly 60 connected to an upright support member 12. The exemplified assembly 60 is constructed to provide a quick release ball height adjustment mechanism. The assembly is connected to the upright support member 12 at a predetermined position above the ground level so as to make it easy for any user of any height to make height adjustments to the suspended soccer ball. As shown, the assembly 60 can be fastened to the support member 12 with, for example, two stainless steel or brass screws 62, in order to prevent rusting of the screws and subsequent failure of the attachment assembly. As shown, the tethered cord can pass through an opening defined by the top portion of the assembly. Any means for obstructing the passage of the tether cord through the opening, such as a steel ring [not shown] or one or more knots 34 can be tied on the end of the tether cord. The tether cord 30 can then be locked in place when it is pulled up into the "V" or wedge 64 formed in the assembly 60 and can be unlocked when pulled down. By the altering the location of the knot 34 relative to the end of the tether cord 30, a user can adjust the desired height or ground position of the soccer ball suspended at the opposite end of the tether cord 30.

Figure 5:
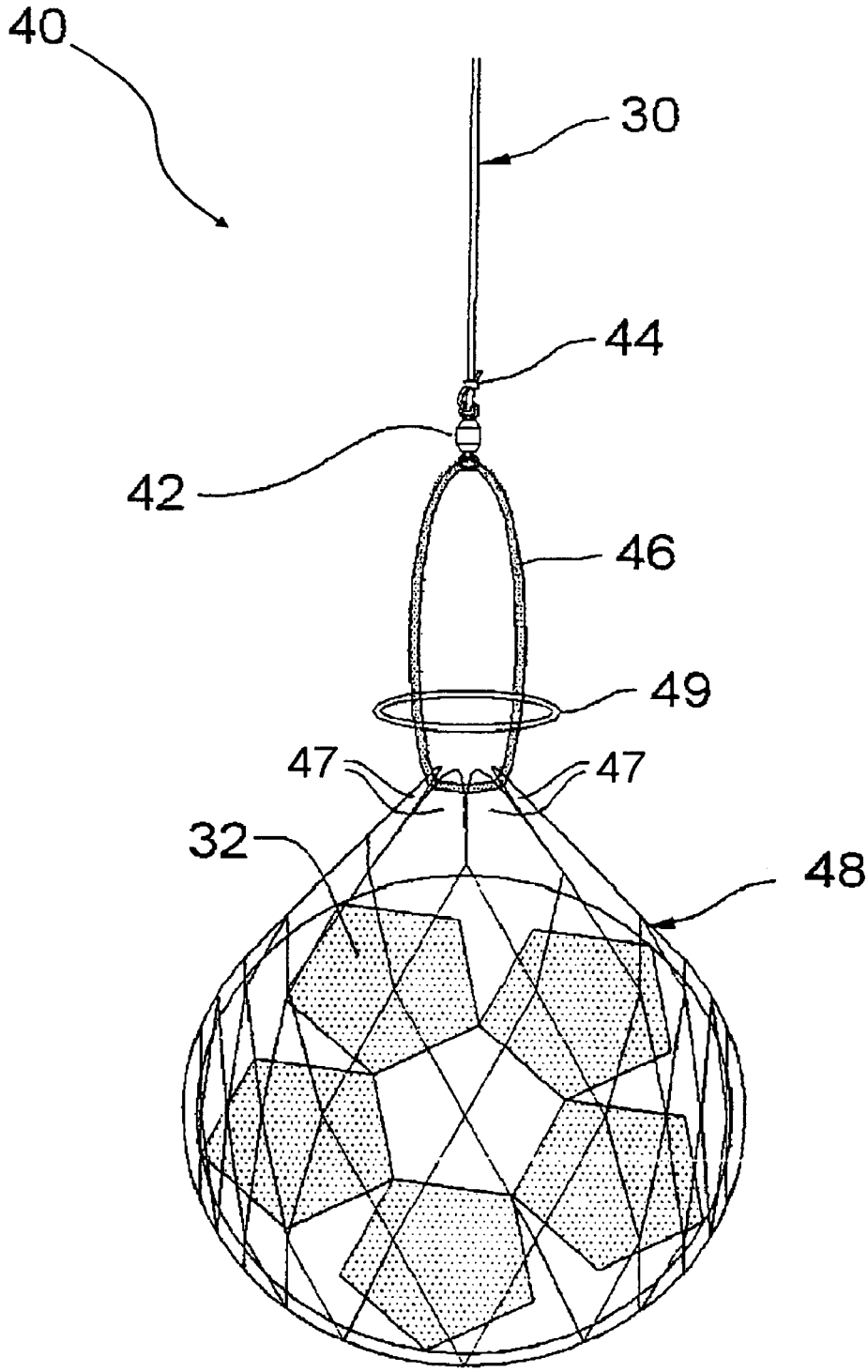
FIG. 5 is a perspective view of an exemplary soccer ball attachment assembly according to one aspect of the present invention.

FIG. 5 illustrates an exemplary soccer ball attachment assembly 40 according to the present invention. As shown, a suspended distal end of a tether cord 30 can be attached to an assembly 40 comprised of a conventional swivel 42, such as for example a ball bearing swivel, connected to an attachment cord 46, such as an elastic cord, the attachment cord 46 being connected to a net 48, sized and shaped to house a soccer ball. One or more knots 44 can be used to attach the tether cord to the stainless steel ball bearing swivel 42 and to attach the attachment cord 46 to the swivel 42. The end of the tether cord, depending on the particular material, can also be seared to prevent unraveling over time. In still another aspect, the use of a swivel is not required in so far as the tether cord can be directed connected to the net. However, it will be appreciated that the use of a swivel can help to prevent undesired twisting and/or tangling of the tether cord during use. The elastic cord can also be attached to itself using a galvanized or stainless steel rope clamp (not shown). The elastic cord 46 can then be looped through each of the net loops 47 on one end of the net 48. By way of example, an 18 inch length of elastic cord can allow the net loops to open enough for either a number 3, 4 or 5 standard size soccer ball or even a non standard sized soccer ball to be easily and quickly removed and replaced inside of the net. A slide ring 49 or other similar device can then be slide down into place by the forces of gravity, to prevent the undesired opening of the net and, hence, the ball from coming out of the net during normal use.

In an alternative aspect, the ball attachment assembly 40 can comprise the direct attachment of a tether cord 30 to a ball 32. For example, a ball 32 can comprise an eyelet defining an aperture configured for the passage of a tether cord, whereby a tether cord can be connected directly to the ball 32.

Figure 6:
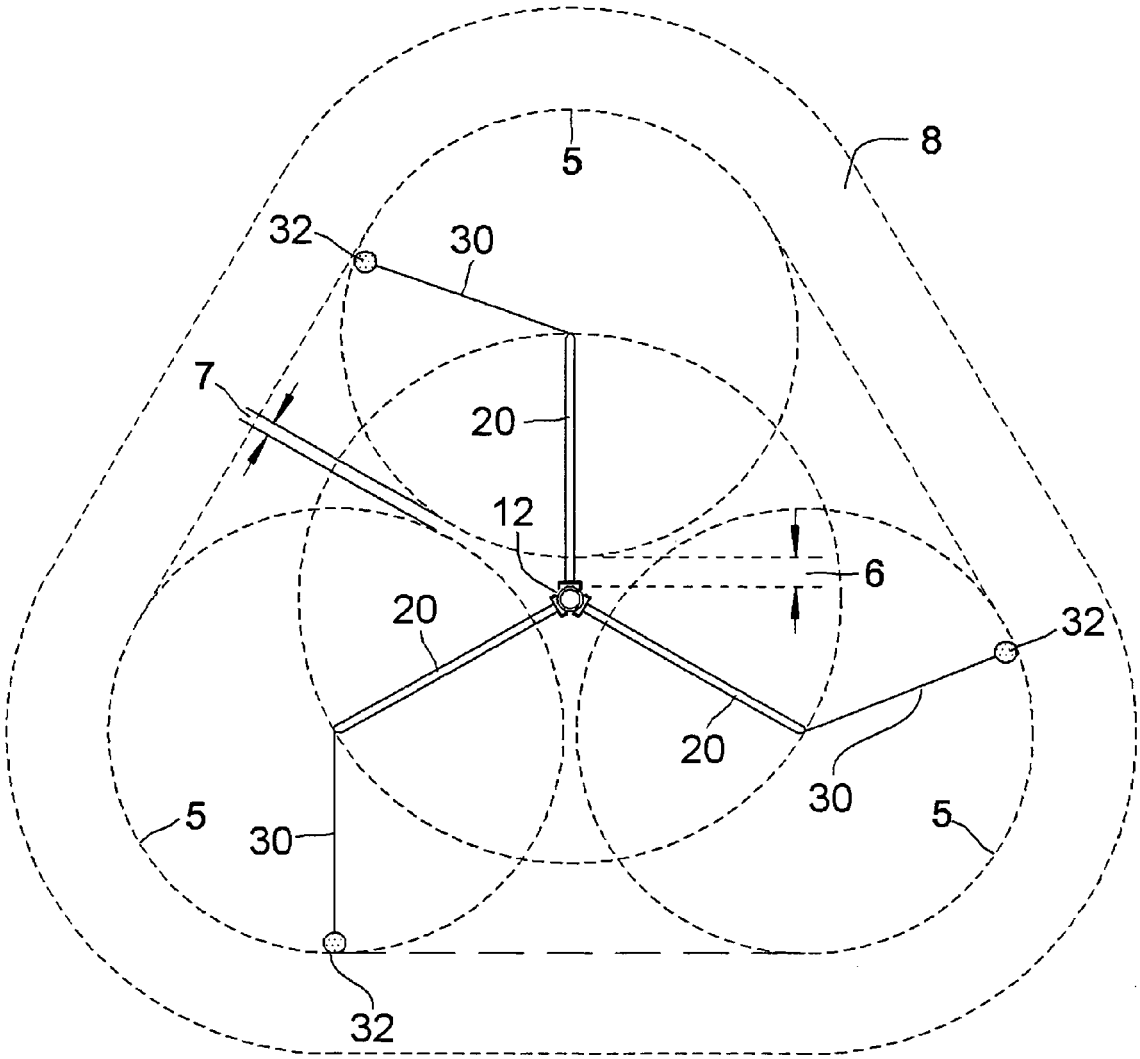
FIG. 6 is a top plan view of an exemplary soccer practice apparatus of the present invention, comprising three arm assemblies circumferentially spaced equally about an upright support member.

It should also be understood that an apparatus according to the present invention is not limited to the aforementioned aspects, which have been depicted as having a single arm assembly. More specifically, in another aspect, an apparatus of the present invention can comprise a plurality of arm assemblies uniformly spaced circumferentially about an upright support member. For example, an apparatus according to the present invention can comprise from 2 to 4 arm assemblies. To that end, FIG. 6 illustrates a top view of an exemplary apparatus comprising three arm assemblies uniformly spaced circumferentially about the upright member 12. As shown, three soccer balls 32 are tethered to the end of each of the three arm assemblies 20. The three circles 5 represent the maximum ball travel distance from the open tip end of each arm assembly. As illustrated, the distance between the open tip ends and the upright member, as well as the distance between any two open tip ends are sufficiently large enough that the three circles do not intersect with either the center upright support member 12, as illustrated by the gap distance 6, nor do they intersect with each other, as illustrated by the gap distance 7. Furthermore, the outer triangular path 8 surrounding around all three of the circles represents an exemplary safe walking path similar to standard sidewalks. This path can, for example, be used as a guide in field placement of single apparatus or multiple apparatuses. For example, in use, an outdoor soccer facility practice arrangement could comprise of six support members arranged in a large circle with three pendulum arms on each pole, thus allowing eighteen individual player stations to be used simultaneously. As one of skill in the art will appreciate, gap distances 6 and 7 will depend on simple geometric relationships between arm assembly length, maximum ball travel distance, and support pole diameter.

In still another aspect, the present invention also provides a soccer practice apparatus kit, comprising one or more arm assemblies 20, as described herein. In one aspect, the kit can further comprise an upright support member 12, supportable at ground level, as described above. Alternatively, in those situations where the one or more arm assemblies are to be connected to an upright support member such as an existing pole, wall or similar structure, the kit may not comprise a support member 12. Furthermore, a kit according to the present invention can also comprise one or more additional soccer practice apparatus components, including without limitation, a tether cord 30, a soccer ball 32, a soccer ball attachment assembly 40, a tether cord attachment assembly 60, hardware for assembly of the various kit components, and literature, including for example, instructions on how to assembly and/or use a soccer practice apparatus of the instant invention. In still another aspect, according to the present invention can further comprise packaging material for housing the various aforementioned kit components.

As one of skill in the art will appreciate, the soccer practice apparatus of the present invention enables a user to repetitively practice virtually all kicking positions including full power ground kicks, mid-volleys and headers. Furthermore, the configuration of the arm assembly and the distance between the open tip end and the upright support member permits a ball to be hit in any direction from any adjusted position above ground or even on the ground over geometrically limited ground positions, without ball contact with the support member. To this end, the only ball-apparatus contact that can occur is with the arm assembly itself. However, due to the outwardly and downwardly extending base and tip portions of the arm assembly, result the ball and/or tether cord sliding downwardly and off of the arm assembly without becoming tangled. It should also be understood and appreciated that the apparatus of the present invention, while being described specifically for use as a soccer practice apparatus, can also be used as a practice apparatus for other sports including, without limitation, tennis, baseball, volleyball and the like.

While this invention has been described in connection with specific aspects, features and embodiments, it is not intended to limit the scope of the invention to the particular aspects, features and embodiments set forth, but on the contrary, it is intended to cover such alternatives, modifications, and equivalents as may be included within the spirit and scope of the invention and that will become apparent to one of ordinary skill in the art upon practicing same.

What is claimed is:

1. A soccer practice apparatus comprising:

a) an upright member having a longitudinal axis and having a lower portion supportable at ground level;

b) at least three arm assemblies, wherein each arm assembly comprises:

i. a mount subassembly comprising at least one spring and being resiliently connected to the upright member at a predetermined position above the lower portion of the upright member;

ii. a primary arm member connected to the mount subassembly and comprising a base portion extending outwardly from the mount subassembly at an angle less than or equal to 90° relative to the longitudinal axis of the upright member, and a tip portion extending outwardly and downwardly from the distal end of the base portion such that an open tip end extends toward ground level; and c) a tether cord having a distal end extending from the open tip end of each primary arm member;

wherein, the distance between each open tip end and the upright member is greater than the distance between each open tip end and the ground level and wherein the at least three arm assemblies are uniformly spaced circumferentially about the upright member.

2. The soccer practice apparatus of claim 1, wherein the primary arm member base portion extends outwardly and downwardly from the mount subassembly at an angle less than 90° relative to the longitudinal axis of the upright member.

3. The soccer practice apparatus of claim 1, wherein the primary arm member extends arcuately outwardly and downwardly from the mount subassembly.

4. The soccer practice apparatus of claim 1, wherein the arm assembly further comprises a second arm member having a first end connected to the mount sub assembly and a second end connected to the base portion of the primary arm member.

5. The soccer practice apparatus of claim 1, wherein the mount subassembly is rigidly connected to the upright member.

6. The soccer practice apparatus of claim 1, further comprising a means for resiliently connecting the mount subassembly to the upright member.

7. The soccer practice apparatus of claim 1, wherein the mount subassembly is connected to the upright member at a predetermined position such that the open tip end of the primary arm member is in the range of from 5 to 12 feet above ground level.

8. The soccer practice apparatus of claim 1, wherein the tip portion of the primary arm member extends arcuately outwardly and downwardly from the distal end of the base portion.

9. The soccer practice apparatus of claim 1, wherein the tip portion comprises a first portion and second portion, wherein the first portion extends outwardly and downwardly from the distal end of the base portion and wherein the second portion extends downwardly from the distal end of the first sub-portion.

10. The soccer practice apparatus of claim 1, wherein the distal end of the tether cord is connected to a soccer ball attachment assembly.

11. The soccer practice apparatus of claim 10, wherein the soccer ball attachment assembly comprises a net sized and shaped to house a soccer ball.

12. The soccer practice apparatus of claim 1, wherein the distal end of the tether cord is connected to a soccer ball.

13. The soccer practice apparatus of claim 1, wherein the primary arm member is hollow and defines a primary arm member conduit for the passage of the tether cord, and wherein a proximal end of the tether cord is threaded through the open tip end of the primary arm member and through at least a portion of the primary arm member base portion.

14. The soccer practice apparatus of claim 10, wherein the mount subassembly further comprises an elongated channel member defining a trough adapted for passage of a portion of the tether cord, the channel member defining a bore and having a proximal end of the primary arm member connected thereto, whereby when the channel member is connected to the upright member a mount subassembly conduit for the passage of the tether cord is defined that is in communication with the primary arm member conduit, and wherein a portion of the tether cord is threaded through the primary arm member conduit and through at least a portion of the mount subassembly conduit.

15. The soccer practice apparatus of claim 13, further comprising a tether cord attachment assembly connected to the upright member, whereby the proximal end of the tether cord is releasably connected to the tether cord attachment assembly to suspend the distal end of the tether cord at or above ground level.

16. The soccer practice apparatus of claim 1, wherein the open tip end of the primary arm member is in a plane substantially parallel to ground level, and wherein the open tip end has a substantially smooth radiused circumferential edge.

17. A soccer practice apparatus comprising:

a) at least three arm assemblies supportable by an upright base member such that they can be uniformly spaced circumferentially about the upright member, each arm assembly comprising:

i. a mount assembly comprising at least one spring and adapted to be resiliently connected to the upright base member and defining a longitudinal axis;

ii. a primary arm member connected to the mount subassembly and comprising a base portion extending outwardly from the mount assembly at an angle less than or equal to 90° relative to the longitudinal axis of the mount subassembly, and a tip portion extending outwardly and downwardly from the base portion such that an open tip extends at least substantially parallel to the longitudinal axis of the mount subassembly; and iii. a secondary arm member having a proximal end connected to the mount subassembly and a distal end connected to the primary arm member at a predetermined position between the mount subassembly and the tip portion; and b) a tether cord extending from the tip portion of each primary arm member and terminated by a soccer ball attachment assembly.

18. A soccer practice apparatus kit, comprising;

a) at least three arm assemblies supportable by an upright base member such that they can be uniformly spaced circumferentially about the upright member, each arm assembly comprising:

i. a mount subassembly comprising at least one spring and adapted to be resiliently connected to the upright base member and defining a longitudinal axis;

ii. a primary arm member connected to the mount subassembly and comprising a base portion extending outwardly from the mount subassembly at an angle less than or equal to 90° relative to the longitudinal axis of the mount subassembly, and a tip portion extending outwardly and downwardly from the base portion such that an open tip end extends at least substantially parallel to the longitudinal axis of the mount subassembly; and iii. a secondary arm member having a proximal end connected to the mount subassembly and a distal end connected to the primary arm member at a predetermined position between the mount subassembly and the tip portion; and b) a tether cord capable of extending from the tip portion of each primary arm member; and c) a soccer ball attachment assembly.

* * * * *